United States Patent [19]

Klotz

[11] Patent Number: 5,033,155

[45] Date of Patent: Jul. 23, 1991

[54] LONG-HANDLED BRUSH SUITABLE FOR CLEANING HOLLOW BODIES

[76] Inventor: Manfred Klotz,
Friedrich-List-Strasse 25, D-4790
Paderborn, Fed. Rep. of Germany

[21] Appl. No.: 249,530

[22] Filed: Sep. 26, 1988

[30] Foreign Application Priority Data

Jun. 3, 1988 [DE] Fed. Rep. of Germany ..... 8807268

[51] Int. Cl.[5] ..... A47L 17/00

[52] U.S. Cl. ..... 15/211; 15/144 B; 15/145; 15/164; 15/210 R; 15/244.3

[58] Field of Search ..... 15/164, 165, 210 R, 15/211, 208, 244.3, 244.1, 176.1, 176.6, 144 B, 145

[56] References Cited

U.S. PATENT DOCUMENTS

| | | | |
|---|---|---|---|
| 234,124 | 11/1880 | Goetting | 15/244.1 |
| 1,660,351 | 2/1928 | Pataki | 15/244.1 |
| 1,820,256 | 8/1931 | Stewart | 15/244.3 |
| 2,333,801 | 11/1943 | Lowston | 15/210 R |
| 2,525,605 | 5/1945 | Kautenberg | 15/244.1 |
| 2,698,955 | 1/1955 | Trindl | 15/176.6 |
| 2,984,852 | 5/1961 | George | 15/144 B |
| 3,319,281 | 5/1967 | Montgomery | 15/244.1 |

FOREIGN PATENT DOCUMENTS

| | | | |
|---|---|---|---|
| 671100 | 1/1939 | Fed. Rep. of Germany | 15/210 R |
| 590855 | 7/1947 | United Kingdom | 15/144 B |
| 686252 | 1/1953 | United Kingdom | 15/144 B |
| 950408 | 2/1964 | United Kingdom | 15/244.1 |

*Primary Examiner*—Harvey C. Hornsby
*Assistant Examiner*—Mark Spisich
*Attorney, Agent, or Firm*—Browdy and Neimark

[57] ABSTRACT

The invention relates to a long-handled brush suitable for cleaning hollow bodies, e.g. drinkware, bottles, thermos flasks, bowls, vases, etc. The brush comprises a handle and a removable cleaning head. The cleaning head has an elastic core and an outer covering of fell or fell-like material, such as natural sheepskin. A headed bolt is preferably used to attach the cleaning head to the handle, with the bolt extending through a central longitudinal channel in the head. The cleaning head is preferably cylindrical and the handle may be telescopically extendable.

15 Claims, 1 Drawing Sheet

LONG-HANDLED BRUSH SUITABLE FOR CLEANING HOLLOW BODIES

FIELD OF THE INVENTION

The present invention relates to a long-handled brush that comprises a handle and a cleaning head and is capable of cleaning a wide range of hollow bodies used in daily tasks.

BACKGROUND OF THE INVENTION

In many versions of the conventional long-handled brush, the handle is normally formed in one piece together with the cleaning head, whose cleaning surface is normally a brush or sponge unit.

Such long-handled brushes exhibit, because of the largely rigid construction and design of the cleaning head, an unsatisfactory cleaning ability which is most noticeable where narrow or deformed hollow bodies are to be cleaned. Such brushes, furthermore, become unusable after a certain period of wear.

The object of the present invention is to provide a long-handled brush possessing a cleaning head which, while having an effective shape and optimal cleaning surface, is replaceable and easy to clean.

SUMMARY OF THE INVENTION

According to the invention there is provided a long-handled brush suitable for cleaning hollow bodies comprising a handle and a cleaning head detachably mounted upon said handle, whereby said cleaning head comprises an elastic core and an enveloping layer comprising fell or fell-like material.

The proposed long-handled brush is provided with an inherently elastic cleaning head having an enveloping layer of fell or fell-like material that constitutes the cleaning surface, whereby the cleaning head is, on the one hand, due to its deformability ideally suited to clean hollow bodies possessing various shapes and constricted zones, and is on the other hand, due to its enveloping layer, which forms an optimal cleaning surface, able to effectively clean the inner surfaces of such hollow bodies.

The advantageous shape of the cleaning head, furthermore, allows the long-handled brush to clean a very wide range of hollow bodies.

A further advantage of the proposed long-handled brush, at least in its preferred forms, is provided by a connection between handle and cleaning head that permits the head to be detached from the former and, if necessary, replaced by another cleaning head.

The choice of materials for the cleaning head, which comprises a core of spongy material and an enveloping layer of fell, permits easy washing of the cleaning head itself, since the latter, being washable and resistant to hot water, can be washed in a washing machine.

The length-adjusting capability of the proposed preferred handle permits the user to easily adjust the length of the entire long-handled brush, and thus provides an adaptability to hollow bodies of various lengths.

The entire long-handled brush is simple and inexpensive to construct, has a durable design and can, because of the advantages it offers, be used in a wide variety of circumstances.

Preferred embodiments of the present invention are described in greater detail.

BRIEF DESCRIPTION OF THE INVENTION

A preferred long-handled brush according to the invention, which is suitable for cleaning a wide variety of hollow bodies such as drinkware, bottles, thermos bottles, light bowls, vases, etc., comprises a handle 1,2 and removably attached thereto is a cleaning head 3,4 comprising an elastic core 5 and an enveloping layer of fell or fell-like material.

While the core 5 comprises natural sponge or spongy synthetic material, the enveloping layer 6 comprises artificial or genuine fell, preferably sheepskin.

The cleaning head possesses, preferably, a basically circular shape and is cylindrical in the longitudinal direction i.e. in the direction of the handle.

The cleaning head 3,4 can, furthermore, possess a cylindrical shape created from a quadratic or rectangular base whose corners are rounded, or an oval base.

It is also possible for the cleaning head 3,4 to have barrel shaped, narrow-waist, conical or frusto-conical embodiments.

Enveloping layer 6 either extends at least over the curved surface of core 5 or is arranged upon the curved surface and both end surfaces of core 5.

The cleaning head 3,4 is attached by means of an insertion/locking connection that allows the cleaning head to be detached from the handle.

Figure 1:
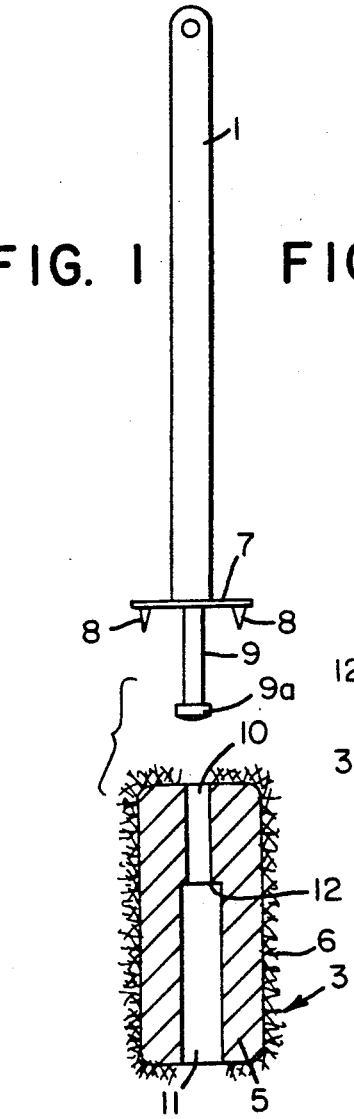
FIG. 1 is a front view of a preferred long-handled brush comprising a handle and a cleaning head (shown in longitudinal section), with the cleaning head detached from the handle.
Figure 2:
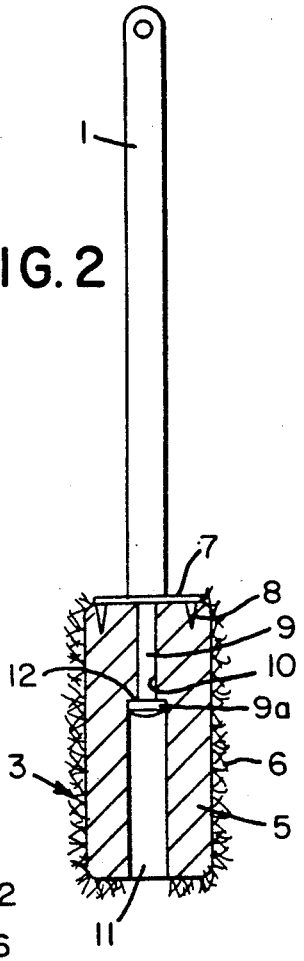
FIG. 2 is a front view of the preferred cleaning brush, with handle and cleaning head (shown in longitudinal section) joined together.

Handle 1 possesses, in accordance with FIGS. 1 and 2, a washer 7 that is located on the cleaning head end of such handle and sits upon the end surface of the core. Washer 7 furthermore features anchoring projections 8, such as points, picks, etc. that fit into the core 5. Attached to the washer 7 and oriented coaxially relative to the handle 1 is a headed bolt 9 which is inserted and locked into a channel 10, 11 that is situated medially in core 5. The channel 10, 11 extends completely through the length of core 5 and comprises a narrow bore 10 and a wide bore 11, whereby head **9*a* of the headed bolt 9 abuts, when the latter has reached the inserted position, the gradation 12 in channel 10, 11, while shaft 9 extends through narrow bore 10 (See FIG. 2**).

Figure 3:
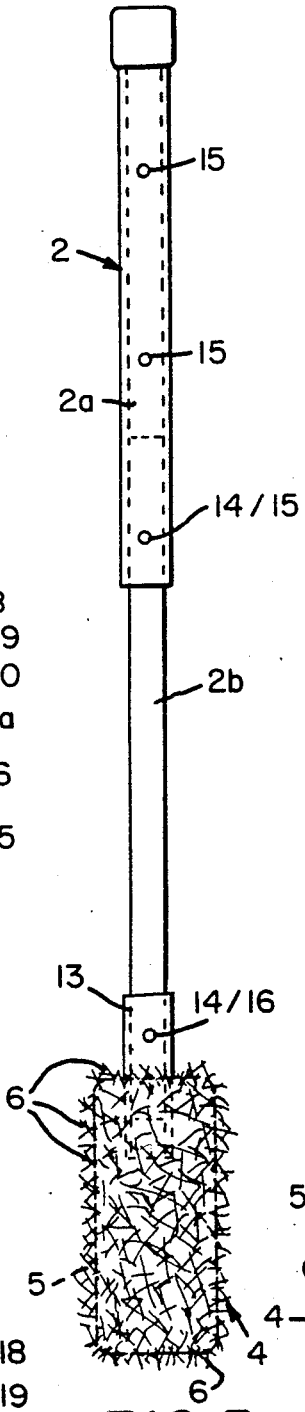
FIG. 3 is a front view of an alternate version of the long-handled brush, having a telescopically length-adjustable handle.
Figure 4:
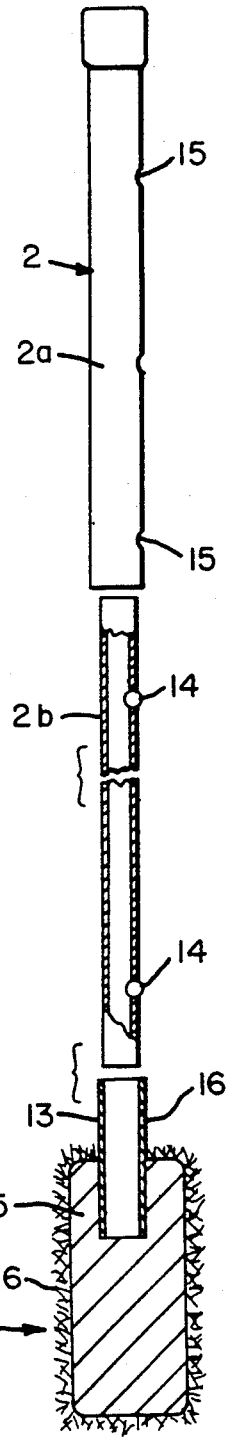
FIG. 4 is a front view, in partial section, of the alternative long-handled brush, with a detached cleaning head and a dismantled handle.

The length of the handle 2 can, in accordance with the alternate version shown in FIGS. 3 and 4, be adjusted in a telescopic manner. The handle 2 is inserted and locked into a connecting collar 13 that is permanently attached to the core 5. Handle 2 possesses, in this connection, one or more tubes **2*a*, 2*b* that can be changed in length by being slid in stages against each other with the aid of locking members 14, which can, for example, be balls. One tube 2b is, with the aid of one locking member 14, slid and locked into connecting collar 13 that projects from the frontal side of core 5**.

It is preferable that the thinner tube 2b possess one spring-loaded locking member 14 situated at a distance from each of the ends of such thinner tube and that pipe 2a possess a plurality of locking holes 15 and collar 13 possess a locking hole 16 so as to permit both tube 2b to lock into collar 13 and tubes 2a, 2b to be longitudinally length-adjusted in stages.

Single or multi-sectioned handle 1, 2 is produced from either synthetic material or metal. The handle 1, 2 can possess a circular, rectangular, oval, or flat cross-section.

Anchoring projections 8, which fit into core 5, or rather, locking member 14, which fits into hole 16 create, in concert with collar 13, which is permanently attached by adhesive or other means to core 5, a reliable joint between hand 1, 2 and cleaning head 3, 4 whereby the latter cannot, during use, twist in relation to handle 1, 2.

The insertion/locking connecting systems described provide a simple and rapid means of either detaching the cleaning head 3, 4 from the handle 1, 2 or replacing such head.

Elastic sponge core 5 is, in accordance with a preferred method, covered by fell/enveloping layer 6, whereby the fell layer 6 has a hair length of approximately 3 to 7 mm, preferably approximately 5 mm.

Figure 5:
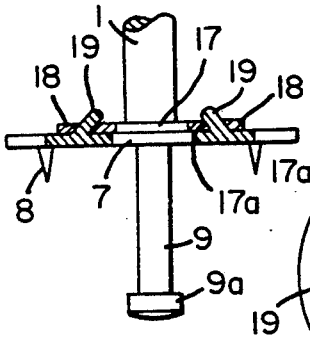
FIG. 5 is a front view, in partial section, of a preferred handle with a double washer capable of being locked together, with the headed bolt.
Figure 6:
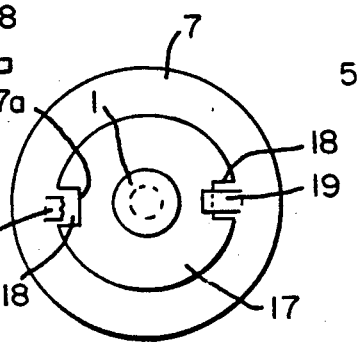
FIG. 6 is a plan view of the same handle with the interlocking double washer.

In the other alternate version of the proposed handle described in FIGS. 5 and 6, a double washer capable of locking together is arranged between and serves to separate the handle 1 and the bolt shaft 9.

Washer 7, having anchoring projections 8 is, in this arrangement, formed in one piece with bolt shaft 9, and handle 1 features a second washer 17, which is, in principal, smaller than washer 7 and formed in one piece with handle 1.

Washer 17 is fitted with one or more opposing open recesses 18 disposed on the edge zone of such washer. The latter possesses two pushed-out locking tongues 19, with the aid of which washer 17 is prevented from turning in relation to recesses 18. Such locking tongues 19 moreover securely fit over the zone of the washer 17a adjacent to each of recesses 18.

Double washer arrangement 7, 17 permits a simple, reliable, yet non-permanent connection between handle 1 and cleaning head 3, whereby lower washer 7 can be either easily fitted onto or detached from upper washer 17.

I claim:

1. A long-handled brush for cleaning hollow bodies comprising, a handle and a detachable cleaning head having a circular shape connected to the handle by means of a connecting collar embedded in a core of the cleaning head and adapted to be connected to an end of said handle; said cleaning head having an enveloping layer of fell or fell-like material positioned over its circular shape and over both end surfaces of the core.

2. A long-handled brush in accordance with claim 1, wherein said core comprises a material selected from the group consisting of natural sponge and spongy synthetic material, and said enveloping layer comprises a material selected from the group consisting of artificial and genuine fell.

3. A long-handled brush in accordance with claim 1, wherein said cleaning head has an essentially circular cylindrical shape.

4. A long-handled brush in accordance with claim 1, wherein said cleaning head has a cylindrical shape created from a rectangular base with rounded corners.

5. A long-handled brush in accordance with claim 1, wherein said cleaning head has a barrel-like shape.

6. A long-handled brush in accordance with claim 1, wherein the core has a curved longitudinal surface.

7. A long-handled brush in accordance with claim 1, wherein the core has a curved longitudinal surface and opposed end surfaces.

8. A long-handled brush in accordance with claim 1, wherein the cleaning head is detachably fixed upon the handle by means of an insertion/locking connecting arrangement by virtue of a detachable connection between said handle and said connecting collar.

9. A long-handled brush in accordance with claim 8, wherein said handle is length-adjustable in a telescopic manner.

10. A long-handled brush in accordance with claim 9, wherein the handle possesses one or more tubes that can be slid into each other and that can, after adjustment, be fixed relative to each other by means of spring loaded locking members, whereby furthermore one tube having a locking member is inserted and locked into said connecting collar which projects from an end surface of the core.

11. A long-handled brush in accordance with claim 8, wherein the handle has a circular cross-section and is constructed of metal or synthetic material.

12. A long-handled brush in accordance with claim 1, wherein said core is elastic and is coated with a fell enveloping layer which has a hair length of approximately 3 to 7 mm.

13. A long-handled brush for cleaning hollow bodies comprising, a handle and a cleaning head having a circular shape detachably mounted upon said handle by insertion locking connection means, wherein said cleaning head comprises an elastic core and an enveloping layer around said core; said handle having and end proximate said cleaning head, said insertion locking connection means comprising a washer means fixed to said proximate end and which is disposed to sit upon an end surface of said core, said washer having anchoring projections that fit into said core, and attached to said washer and coaxially to said handle, is a headed bolt insertably lockable into a graduated narrow medial channel through said core; wherein said enveloping layer is of fell or fell-like material and is positioned over both end surfaces of the core.

14. A long-handled brush in accordance with claim 13 wherein said washer means is a double washer comprising two parts locked together and disposed between the handle and the cleaning head; a first part fixed to the handle proximate said cleaning head and a second part attached to the end surface of said core, the parts cooperating to permit the cleaning head to be easily detached from said handle.

15. A long-handled brush in accordance with claim 14 wherein a washer comprising said first part is arranged adjacent to the handle and possesses one or more oppositely facing recesses and a second washer comprising said second part attached to said headed bolt and said anchoring projections which has locking tongues that fit into said recesses formed on said first part to prevent rotation of the handle.

* * * * *